US010357872B1

(12) United States Patent
Gabelsberg

(10) Patent No.: US 10,357,872 B1
(45) Date of Patent: Jul. 23, 2019

(54) WINDING CONE ADAPTOR

(71) Applicant: Jeffrey Gabelsberg, Oklahoma City, OK (US)

(72) Inventor: Jeffrey Gabelsberg, Oklahoma City, OK (US)

( * ) Notice: Subject to any disclaimer, the term of this patent is extended or adjusted under 35 U.S.C. 154(b) by 232 days.

(21) Appl. No.: 15/666,013

(22) Filed: Aug. 1, 2017

(51) Int. Cl.
*B25B 27/30* (2006.01)
*E06B 9/56* (2006.01)

(52) U.S. Cl.
CPC ..... *B25B 27/30* (2013.01); *E06B 9/56* (2013.01)

(58) Field of Classification Search
CPC ..... B25B 27/30; E06B 9/56; E06B 9/76
See application file for complete search history.

(56) References Cited

U.S. PATENT DOCUMENTS 3,651,719 A * 3/1972 Wessel ..... B25B 13/463 81/63.2
3,779,537 A 12/1973 Kalister
4,142,283 A * 3/1979 Walker ..... B25B 13/48 29/227
4,253,350 A * 3/1981 De Tarr ..... B25B 25/00 81/486
5,605,079 A 2/1997 Way
5,911,797 A * 6/1999 Trevorrow ..... B25B 27/30 81/129
6,263,541 B1 7/2001 Scates
6,508,461 B1 * 1/2003 Trevorrow ..... B25B 27/30 16/299
6,615,897 B2 9/2003 Dorma
6,986,508 B2 1/2006 Alers et al.
7,073,411 B2 * 7/2006 Primrose ..... B25B 27/30 81/488

* cited by examiner

*Primary Examiner* — David B. Thomas
(74) *Attorney, Agent, or Firm* — Bruce D. LaBrie; Resolution Legal Group

(57) ABSTRACT

An apparatus for use with a winding cone for a door assembly includes a housing having a first piece and a second piece, a fastener for connecting the first piece to the second pieces, a dowel extending from the housing to engage at least one hole in the winding cone, and holes on an outer surface to accept a winding bar.

20 Claims, 3 Drawing Sheets

WINDING CONE ADAPTOR

CROSS REFERENCE TO RELATED APPLICATIONS

This application claims the benefit of U.S. Provisional Application Ser. No. 62/370,357 entitled WINDING CONE ADAPTOR, filed Aug. 3, 2016.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention relates generally to a winding cone for a garage door, and more particularly to a winding cone adaptor capable of use in a low head room or cramped environment and used to increase the tension of a garage door spring.

Overhead doors, most commonly seen and known as garage doors, are used in many commercial and residential applications. Installed with multiple hinged sections on several guiding tracks, the doors can be raised and lowered with the help of pulleys, cables and torsion springs. A horizontal shaft (or torsion rod) extends near the top of the door opening and the pulleys are typically positioned on and near the ends of the shaft. The cables attach near the bottom of the door and wrap around the pulleys. The torsion springs surround the shaft and allow the door to be easily opened and closed by counteracting the weight of the door. A frusto-conical piece called a winding cone is designed to engage an end of the torsion spring and to be fixed to the shaft. Engagement with the torsion spring is typically accomplished using annular grooves on the frusto-conical surface that engage coils of the torsion spring. Fixation to the shaft is typically accomplished with a set screw that can be tightened on the winding cone to securely engage the shaft.

Tension in the spring is necessary to easily raise the door. To impart the needed tension in the spring, installers make use of holes in the winding cone to insert winding rods. By placing a winding rod into one of the holes in the winding cone, force can be exerted on the end of the winding rod to rotate the winding cone, thereby increasing tension in the spring. Since winding cones typically have four such winding holes, after rotation of the winding cone has reached a limit due to the radial winding rod, another winding rod is inserted into another winding hole. The first winding rod is removed to permit additional rotation of the winding cone and spring. The steps are then repeated until the spring is sufficiently wound.

Several common situations arise that make it difficult or impossible to properly impart the desired tension on the torsion spring. A confined area in which to maneuver the radial winding rods can result from low headroom or an immovable obstruction in the vicinity of the winding cone. Since winding cones typically have only 4 winding holes equally spaced around the outside surface, the winding cone must be rotated 90 degrees in order for the next winding hole to be accessible for another winding rod. If 90 degrees of rotation is not plausible, tensioning of the spring becomes very difficult. It is to the deficiencies in the prior art that the present invention is directed.

BRIEF SUMMARY OF THE INVENTION

Various embodiments of the present disclosure are generally directed to an adaptor for use with a winding cone for a door assembly.

In some embodiments, an apparatus includes a housing having a first piece and a second piece and a fastener for connecting the first piece to the second piece. A dowel extends from the housing and is configured to engage at least one hole in the winding cone to secure the adaptor to the winding cone. Holes on an outer surface of the housing are configured to accept a winding bar.

In other embodiments, the first piece and the second piece define a passage for a shaft, wherein the shaft is attached to the winding cone. In yet another embodiment, an outer surface of the housing includes at least four holes configured to accept a winding bar. The fastener for connecting the first piece to the second piece is a bolt in some embodiments. In other embodiments, two dowels extend from the housing configured to engage holes in the winding cone.

In still other embodiments, a dowel is attached to the first piece, a second dowel is attached to the second piece, and the second dowel is configured to engage a hole in the winding cone. The housing can be substantially cylindrical.

In some embodiments, a winding cone adaptor includes a two piece hinged housing, a fastener for securing the two pieces of the housing together, a dowel connected to each of the two pieces of the housing and configured to engage holes in the winding cone, and holes on an outer surface of the housing configured to accept a winding bar.

In other embodiments, the winding cone adaptor includes a hollow passage in the housing to permit passage of a shaft. An outer surface of the housing can include at least four holes configured to accept a winding bar, and fastener can be a bolt for securing the pieces of the housing together. In yet other embodiments, the housing can be cylindrical and has eight holes on the outer surface.

In another embodiment an adaptor for a winding cone includes a housing having a first piece and a second piece, defining a passage for a shaft that is attached to the winding cone. A fastener secures the first piece to the second piece, a pair of dowels project radially from the housing toward the passage, and the dowels are configured to engage holes in the winding cone. Holes on a circumferential surface of the housing are configured to engage a winding rod.

In still another embodiment, a hinge is attached to the first piece and the second piece and the housing has at least four holes on the circumferential surface. The fastener can be a clasp, a bolt or other means of securing the first piece and the second piece. The housing can be cylindrical and can have eight holes on the circumferential surface.

DETAILED DESCRIPTION OF THE INVENTION

Figure 1:
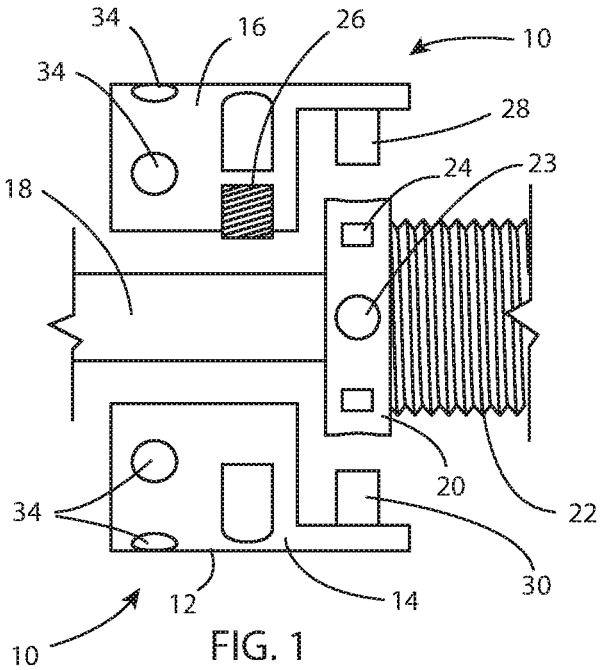
FIG. 1 is a perspective view of a winding cone adaptor in accordance with the present invention.

Referring now to the drawings, and more particularly to FIG. 1, presently preferred embodiments of a winding cone adaptor are illustrated in accordance with the present invention. A winding cone adaptor 10 includes a housing 12 that has first and second pieces 14, 16. Additional views of the winding cone adaptor can be seen in FIG. 2 and FIG. 3. Also shown in FIG. 1 are a shaft 18, a winding cone 20, and a torsion spring 22. The shaft 18 extends through the winding cone 20 and the torsion spring 22. Preferably, the winding cone 20 is affixed to the shaft 18 with the set screw 24, and includes a frusto-conical portion (not shown) that is secured to the spring 22 with annular grooves that engage the coils of the spring 22 in a fashion that is well known in the industry. The winding cone 20 typically includes four winding holes 23 (only one shown in FIG. 1) for use with a winding rod.

A presently preferred embodiment of the adaptor 10 includes a bolt 26 to fasten the first piece 14 of the housing to the second piece 16 of the housing. The bolt 26 is preferably inset into the housing to minimize any protrusion of the bolt 26 beyond the circumference of the housing. Threads are preferably formed in the housing to enable the bolt 26 to hold the first piece 14 securely to the second piece 16. An Allen head bolt 26 is preferred to allow a hex key tool to easily fit into the inset portion of the housing, thereby allowing the inset to be small enough that a wrench is not required to fit into the inset. However, other types of fasteners are within the scope of the present invention, such as a bolt with a nut, clasp, latch, clamp, or other means that is able to fasten the first piece 14 securely to the second piece 16.

Figure 2:
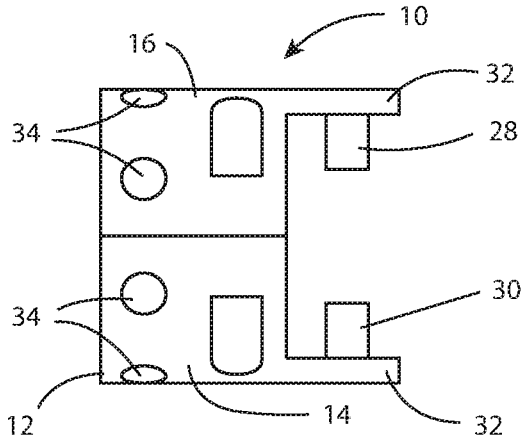
FIG. 2 is a perspective view of the winding cone adaptor of FIG. 1 in accordance with the present invention.

As shown in FIG. 2, one or more dowels 28, 30 are preferably mounted in a radial direction on the housing of the adaptor 10. The dowels 28, 30 should be of a size that can fit into an existing winding hole 23 in a winding cone 20, and are therefore very close or identical in diameter to that of a winding rod. It is advantageous to mount the one or more dowels 28, 30 on a tab 32 that extends beyond the main part of the housing.

Figure 3:
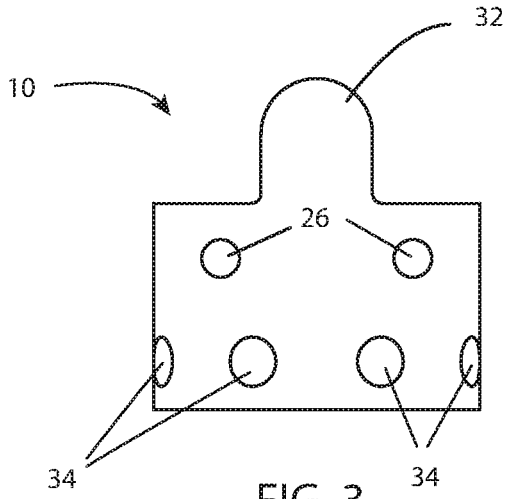
FIG. 3 is a perspective view of the winding cone adaptor of FIG. 1 in accordance with the present invention.

Winding holes 34 are shown in FIG. 1-3 located around the circumference of the adaptor 10. The holes 34 are preferably of similar size to those of the winding cone 20 and serve the same purpose as the winding holes 23 on the winding cone 20. The adaptor 10 preferably includes at least four winding holes 34, but it will be evident that additional holes located around the circumference of the adaptor 10 are advantageous.

Figure 4:
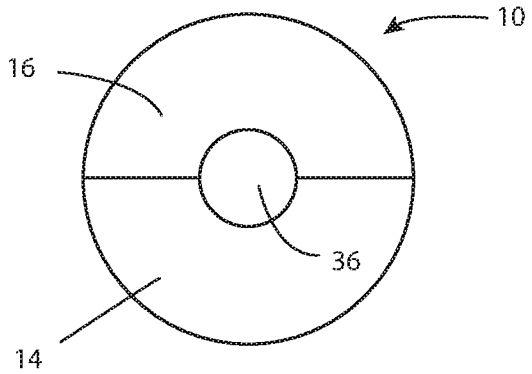
FIG. 4 is a plan view of winding cone adaptor of FIG. 1 in accordance with the present invention.

FIG. 4 depicts a view of the winding cone adaptor 10 from the end opposite of the dowels 28, 30. In this view, a hollow passage 36 is shown in the housing that is suitable in size for the passage of a shaft 18. Although it may be beneficial that passage 36 fits tightly around the shaft 18, it is not necessary, as the primary purpose of the passage 36 is to allow the shaft 18 to extend through the housing when the adaptor 10 is assembled.

Figure 5:
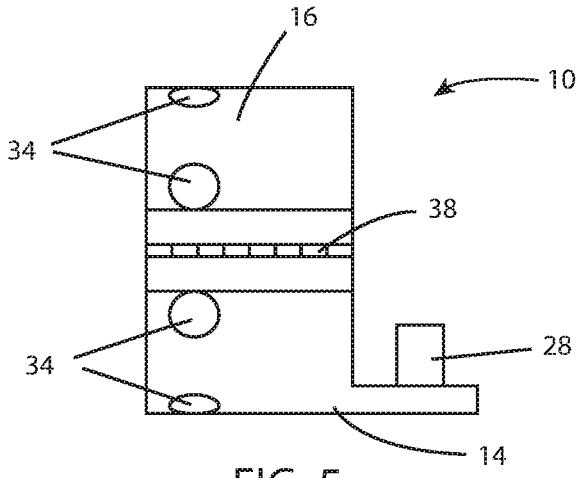
FIG. 5 is a perspective view of a winding cone adaptor in accordance with the present invention.
Figure 6:
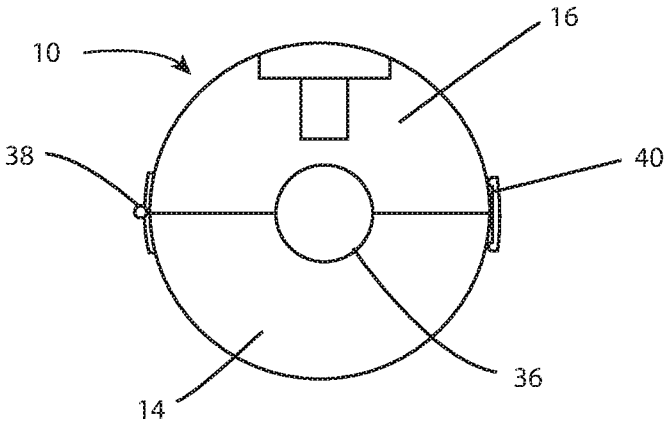
FIG. 6 is a perspective view of the winding cone adaptor of FIG. 5 in accordance with the present invention.

Referring now to FIG. 5 and FIG. 6, shown therein is an alternate embodiment of the winding cone adaptor 10 of the present invention. As in the previous embodiments, the adaptor 10 in FIG. 5 and FIG. 6 includes a housing with first and second pieces 14, 16, a dowel 28, a tab 32, winding holes 34, and a passage 36. In this embodiment, the adaptor 10 also includes a hinge 38 connected to the first and second pieces 14, 16 of the housing. This embodiment is also shown with a clasp 40 for securing the first and second pieces 14, 16 of the housing together, but can also use fasteners as indicated in the previous embodiments such as an Allen head bolt, bolt with a nut, clasp, latch, clamp, or other means. The embodiment shown in FIG. 5 and FIG. 6 is shown with one dowel 26, but this embodiment is not so limited, as additional dowels can be added.

In all embodiments, the adaptor 10 is preferably made of steel, aluminum, or other durable material that is able to endure significant force while in use as follows. To properly install and use the adaptor 10 on an overhead door equipped with a winding cone 20, the first piece and second piece 14, 16 of the housing should be separated to fit the adaptor 10 onto the winding cone 20. In the embodiments of FIG. 1-3, the adaptor 10 is then securely assembled using the Allen bolt 26 or other fastener as the adaptor 10 may be equipped, with the dowel 28 (or additional dowels if equipped) inserted into the winding hole 23 in the winding cone 20. Similarly, the embodiments of FIG. 5. and FIG. 6 are used by separating the hinged first piece and second piece 14, 16 to place the adaptor 10 onto the winding cone 20. The assembly is then secured using the clasp 40 or other fastener as the adaptor 10 may be equipped. One or more dowels 28 are then inserted into the winding hole(s) 23 of the adaptor cone 20. In either case, the shaft 18 passes through the passage 36 of the adaptor 10.

Upon secure attachment of the adaptor 10 to the winding cone 20, the user may then wind the torsion spring 22 to a suitable tension. The winding holes 34 in the adaptor 10 are used the same as the winding holes 23 in the winding cone 20 to wind the torsion spring 22. A torsion rod in inserted into one of the winding holes 34 and a suitable force is applied to rotate the adaptor 10, thereby rotating the attached winding cone 20 to adjust the tension in the spring 22. After the assembly has been rotated far enough to access another winding hole 34, another torsion rod is inserted into another winding hole 34. The process is then repeated until the tension in the spring 22 has reached a desirable level. In a case with relatively little headroom, additional winding holes 34 in the adaptor 10 provide a way to insert a torsion rod into a winding hole 34 that may not be accessible in the winding cone 20. For example, since typical winding cones have four winding holes 23, a winding cone 20 would require 90 degree rotation to expose the next winding hole 23. If a low headroom condition or an obstruction prevents 90 degree rotation, an eight hole adaptor 10 on requires a 45 degree rotation to insert a subsequent winding rod. Likewise, a low headroom condition or an obstruction can sometimes be avoided if the desired winding holes are moved laterally along the shaft 18. Installation of the adaptor 10 has the effect of offsetting the winding holes from the location of the winding holes on the winding cone 20. Since the adaptor 10 can be made in multiple lengths, the amount of offset of the winding holes can be useful to clear the assembly from many obstructions.

It is to be understood that even though numerous characteristics of various embodiments of the present disclosure have been set forth in the foregoing description, together with details of the structure and function of various embodiments, this detailed description is illustrative only, and changes may be made in detail, especially in matters of structure and arrangements of parts within the principles of the present disclosure to the full extent indicated by the broad general meaning of the terms in which the appended claims are expressed. For example, the particular elements may vary depending on the particular application without departing from the spirit and scope of the present disclosure.

I claim:

1. An adaptor for use with a winding cone for a door assembly, wherein the winding cone has holes for use with a winding bar, the adaptor comprising:

a housing having a first piece and a second piece;

a fastener for connecting the first piece to the second piece;

a dowel extending from the housing configured to engage at least one hole in the winding cone to secure the adaptor to the winding cone; and holes on an outer surface of the housing configured to accept a winding bar.

2. The adaptor of claim 1 wherein the first piece and the second piece define a passage for a shaft, the shaft attached to the winding cone.

3. The adaptor of claim 1 wherein an outer surface of the housing includes at least four holes configured to accept a winding bar.

4. The adaptor of claim 1 wherein the fastener for connecting the first piece to the second piece is a bolt.

5. The adaptor of claim 1 having two dowels extending from the housing configured to engage holes in the winding cone.

6. The adaptor of claim 1 wherein the dowel is attached to the first piece, a second dowel is attached to the second piece, and the second dowel is configured to engage a hole in the winding cone.

7. The adaptor of claim 1 wherein the housing is substantially cylindrical.

8. A winding cone adaptor, comprising;

a two piece hinged housing;

a fastener for securing the two pieces of the housing together;

a dowel connected to each of the two pieces of the housing and configured to engage holes in the winding cone; and holes on an outer surface of the housing configured to accept a winding bar.

9. The winding cone adaptor of claim 8, further comprising a hollow passage in the housing to permit passage of a shaft.

10. The winding cone adaptor of claim 8 wherein an outer surface of the housing includes at least four holes configured to accept a winding bar.

11. The adaptor of claim 8, wherein the fastener is a bolt for securing the pieces of the housing together.

12. The adaptor of claim 8 wherein the housing is cylindrical.

13. The adaptor of claim 8 wherein the housing has eight holes on the outer surface.

14. An adaptor for a winding cone, comprising, a housing having a first piece and a second piece, defining a passage for a shaft that is attached to the winding cone;

a fastener for securing the first piece to the second piece;

a pair of dowels projecting radially from the housing toward the passage, wherein the dowels are configured to engage holes in the winding cone; and holes on a circumferential surface of the housing configured to engage a winding rod.

15. The adaptor of claim 14 further comprising a hinge attached to the first piece and the second piece.

16. The adaptor of claim 14 wherein the housing has at least four holes on the circumferential surface.

17. The adaptor of claim 14 wherein the fastener is a clasp.

18. The adaptor of claim 14 wherein the fastener is a bolt.

19. The adaptor of claim 14 wherein the housing is cylindrical.

20. The adaptor of claim 14 wherein the housing has eight holes on the circumferential surface.

* * * * *